United States Patent [19]

Heisterberg

[11] 4,132,532

[45] Jan. 2, 1979

[54] MULTI-LIFT DRY SEAL GASHOLDER

[75] Inventor: Milton W. Heisterberg, Flossmoor, Ill.

[73] Assignee: GATX Tank Erection Corporation, Chicago, Ill.

[21] Appl. No.: 834,462

[22] Filed: Sep. 19, 1977

[51] Int. Cl.[2] ..... F17B 1/00

[52] U.S. Cl. ..... 48/174; 48/176; 48/178; 220/85 A

[58] Field of Search ..... 48/174, 176, 178, 179; 220/85 A, 86 B, 216, 218; 52/2

[56] References Cited

U.S. PATENT DOCUMENTS

| | | | |
|---|---|---|---|
| 2,171,567 | 9/1939 | Jagschitz | 48/178 |
| 2,280,768 | 4/1942 | Graver | 48/176 |
| 2,337,010 | 12/1943 | Wiggins | 48/178 |
| 2,478,730 | 8/1949 | Wiggins | 48/178 |
| 2,583,536 | 1/1952 | Allen | 48/178 |
| 2,606,824 | 8/1952 | Allen | 48/178 |
| 2,631,093 | 3/1953 | Allen | 48/174 |
| 3,436,196 | 4/1969 | Wiggins | 48/174 |

*Primary Examiner*—S. Leon Bashore
*Assistant Examiner*—George C. Yeung
*Attorney, Agent, or Firm*—Vogel, Dithmar, Stotland, Stratman & Levy

[57] ABSTRACT

An expansible dry seal gasholder includes a piston disposed within a container side wall and a plurality of generally annular fender structures disposed between the piston and the side wall and spaced therefrom and from each other, with flexible fabric sealing members interconnecting the piston and the fender structures and the side wall and closing the spaces therebetween. Respectively pivotally mounted between the arms of a clevis at the top of each fender structure are generally L-shaped latch members, each having one end thereof connected by a roller chain to the upper end of the next innermost fender structure, with the latch member of the innermost fender structure being connected to the upper end of the piston. The clevis brackets are adjustable effectively to vary the lengths of the chains. Each latch member has an adjustable-length arm which is pivoted by the action of the associated chain into engagement with the adjacent fender structure or piston to which that chain is connected when that adjacent fender structure or piston has been raised above said latch member to the point where the chain is fully extended.

19 Claims, 7 Drawing Figures

MULTI-LIFT DRY SEAL GASHOLDER

BACKGROUND OF THE INVENTION

The present invention relates to expansible dry seal gasholders of the vertical-lift piston type and, in particular, to such gasholders in sizes of 100,000 cubic feet capacity and larger.

Such a gasholder is disclosed in U.S. Pat. No. 2,606,824, issued to J. W. Allen on Oct. 12, 1952, which gasholder comprises an outer container in which is disposed a vertically movable piston and an annular fender or backstop structure disposed between the piston and the container side wall and spaced therefrom, with flexible sealing means connecting the fender structure to the side wall and the piston for closing the spaces therebetween and permitting vertical movement of the fender structure and piston with respect to each other and with respect to the side wall, whereby the piston and fender structure cooperate with the side wall to define an expansible gas storage chamber therebeneath. In the Allen apparatus the piston rises into engagement with the fender structure, so that further lifting of the piston also lifts the fender structure. The piston cannot rise above the fender structure, so that the maximum volume of the storage chamber is determined by the distance that the fender structure can be lifted, which is in turn determined by the length of the sealing means interconnecting the fender structure and the container side wall.

Another version of this type of expansible gasholder is disclosed in U.S. Pat. No. 3,436,196, issued to J. H. Wiggins on Apr. 1, 1969. Wiggins provides hook lift structures and cable linkages between the piston and the fender structures, which arrangement permits the piston to rise above the fender structure.

But in both Wiggins and Allen, when the piston is at a level of maximum slack in the sealing member which connects it to the fender structure, the piston can undergo considerable lateral movement, which may cause one side of the piston to ride up inside the hook or compression member of the fender structure and not properly engage it, which could result in jamming of the piston against the fender structure. Furthermore, in both of these prior art structures, the piston and the fender structure are capable of considerable rotational movement which can place severe stresses on the flexible sealing members therebetween. These difficulties may be particularly aggravated in the case of gasholders with high rates of gas input and discharge, such as in the gas storage systems utilized in the steel industry.

SUMMARY OF THE INVENTION

The present invention relates to improved means for lifting the fender structure of a gasholder by the lifting movement of the piston as the piston rises in response to the introduction of gas into the storage chamber of the gasholder.

In general, the present invention relates to improved lifting means for maintaining the piston and fender structure in proper alignment during the raising and lowering thereof.

It is an important feature of the present invention that the piston and fender structure are interconnected by a linkage mechanism, the length of the linkage mechanism and the vertical extent of each of the piston and fender structure being such that the piston and fender structure are always in vertically overlapping relationship with one another, so that neither can move directly beneath the other.

It is another feature of the invention that the linkage mechanism comprises a roller chain which accommodates vertical movement of the piston and fender structure with respect to each other but substantially prevents rotational movement thereof with respect to each other because of the lateral rigidity of the chain.

It is another feature of the invention that latch mechanism is coupled to the piston and the fender structure and is movable into engagement with the piston when the latter has moved a predetermined distance above the fender structure effectively to prevent lateral movement of the piston and the fender structure with respect to each other.

Another feature of the invention is the pivotal connection of the linkage mechanism to the latch mechanism for effecting rotational movement of the latch mechanism as the piston rises and falls.

These features are attained, and it is an important object of this invention to attain these advantages by providing an expansible fluid storage apparatus, comprising a container having a vertically extending side wall, a vertically movable piston disposed within the side wall and spaced a predetermined distance therefrom, a vertically movable generally annular fender structure disposed between the side wall and the piston and spaced therefrom, first flexible sealing means interconnecting the piston and the fender structure and closing the space therebetween, second flexible sealing means interconnecting the fender structure and the side wall and closing the space therebetween, and linkage mechanism interconnecting the piston and the fender structure for accommodating vertical movement thereof with respect to each other and substantially preventing circumferential movement thereof with respect to each other, whereby the piston and the fender structure and the sealing means cooperate with the side wall to define an expansible storage chamber with the linkage mechanism serving to maintain the piston and the fender structure in proper alignment.

Further features of the invention pertain to the particular arrangement of the parts of the fluid storage apparatus whereby the above-outlined and additional operating features thereof are attained.

The invention, both as to its organization and method of operation, together with further objects and advantages thereof, will best be understood by reference to the following specification taken in connection with the accompanying drawings.

DESCRIPTION OF THE PREFERRED EMBODIMENT

Figure 1:
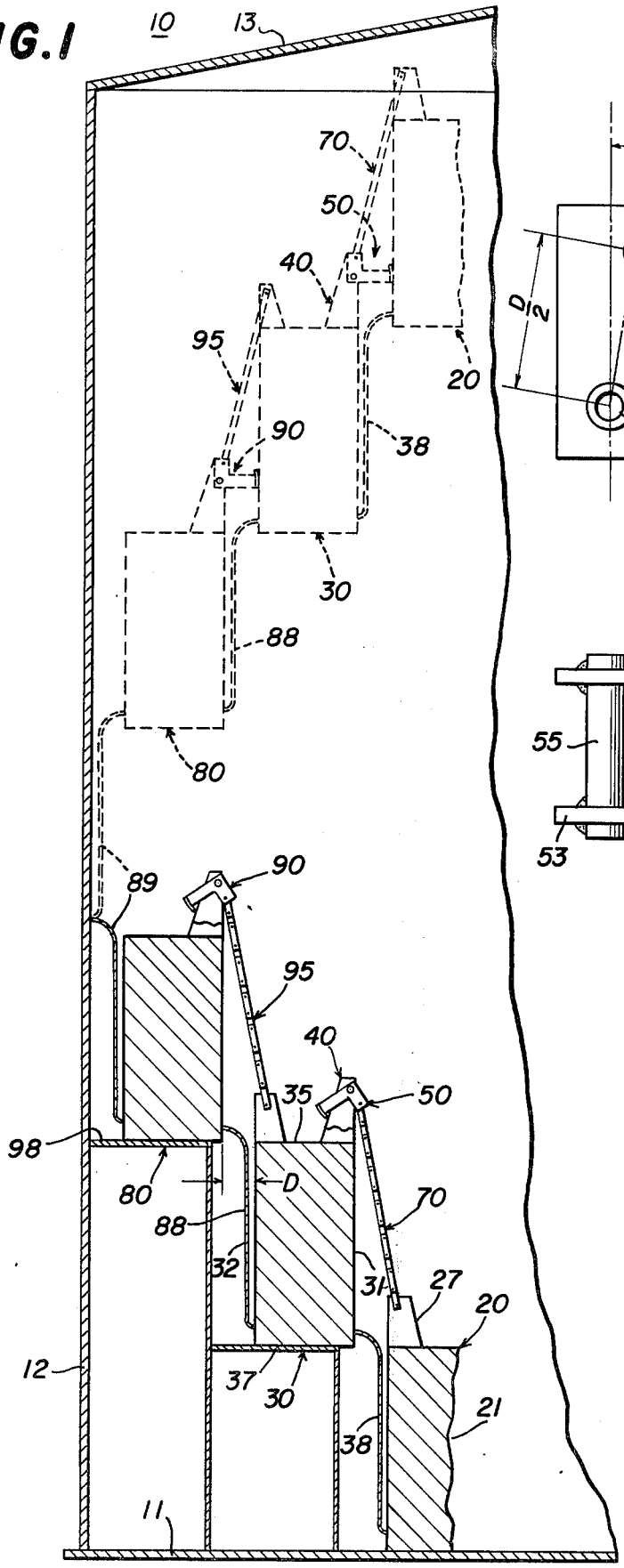
FIG. 1 is a fragmentary view in vertical section of a gasholder constructed in accordance with and embodying the features of the present invention, and illustrating two positions of the piston and the fender structure.

Referring now to FIG. 1 of the drawings, there is illustrated a dry seal gasholder, generally designated by the numeral 10, which includes a substantially circular floor 11 and a cylindrical vertically extending side wall 12 which is closed at the upper end thereof by a roof 13, thereby to provide an enclosed container for the storage of fluids such as gas.

Figure 3:
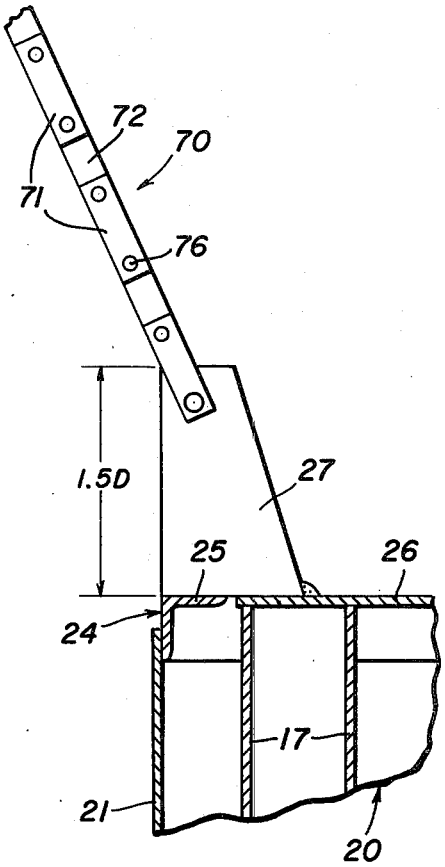
FIG. 3 is an enlarged fragmentary view in vertical section of the upper portion of the piston illustrated in FIG. 1.
Figure 4:
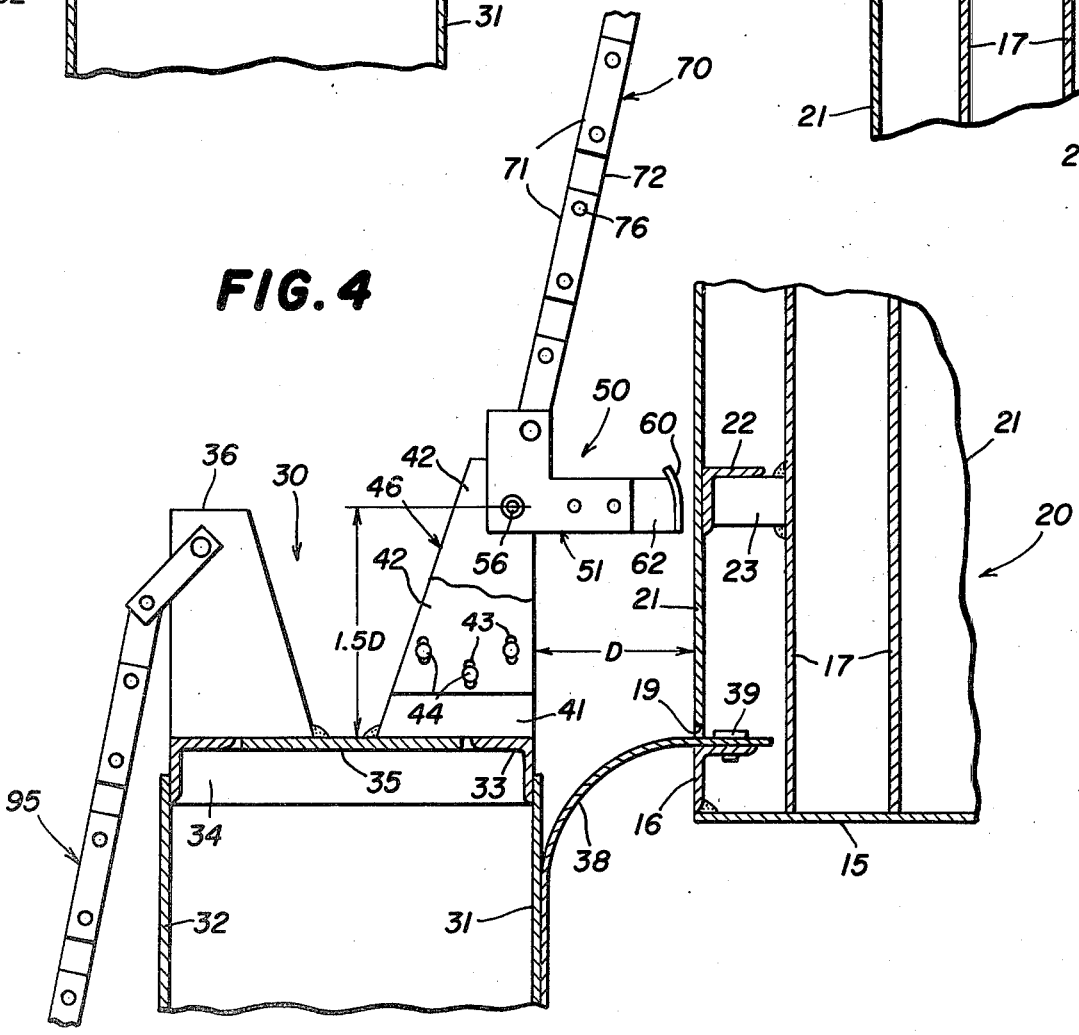
FIG. 4 is an enlarged fragmentary view in vertical section of the bottom portion of the piston and the upper portion of the adjacent fender structure of FIG. 1 in the uppermost positions thereof.

Referring also to FIGS. 3 and 4 of the drawings, there is disposed in the gasholder 10 a generally circular piston, generally designated by the numeral 20, which includes a substantially circular bottom wall 15 having secured thereto around the outer edge thereof a bottom attachment ring 16 which is in the form of an angle iron having an upwardly extending cylindrical flange integral at the upper end thereof with an inwardly extending flange. Fixedly secured to the bottom wall 15 and extending vertically upwardly therefrom are a plurality of spaced-apart concentric cylindrical plates 17 for providing rigidity to the piston 20. Fixedly secured to the outer one of the plates 17 adjacent to the lower end thereof and extending radially outwardly therefrom at circumferentially spaced-apart points therealong are a plurality of struts 23 (one shown), the outer ends of which are interconnected by an annular stiffening ring 22 which is in the form of an angle iron substantially identical to the bottom attachment ring 16.

Fixedly secured to the vertically extending flange of the stiffening ring 22 is a vertically extending outer side wall 21 which is substantially cylindrical and arranged substantially in vertical alignment with the vertically extending flange of the bottom attachment ring 16 but spaced a slight distance thereabove to define a gap or aperture 19. Fixedly secured to the inner surface of the side wall 21 at the upper end thereof and extending upwardly thereabove is a top attachment ring 24 which is substantially identical in configuration to the bottom attachment ring 16. Disposed within the top attachment ring 24 and arranged substantially coplanar with the top flange 25 thereof and fixedly secured thereto is a generally circular top plate which is in turn secured to the upper ends of the plates 17, thereby to define a rigid and closed annular piston structure 20. Fixedly secured to the top plate 26 and the top flange 25 of the top attachment ring 24 and extending vertically upwardly therefrom at circumferentially spaced-apart points therealong are a plurality of attachment plates 27 (one shown).

Figure 2:
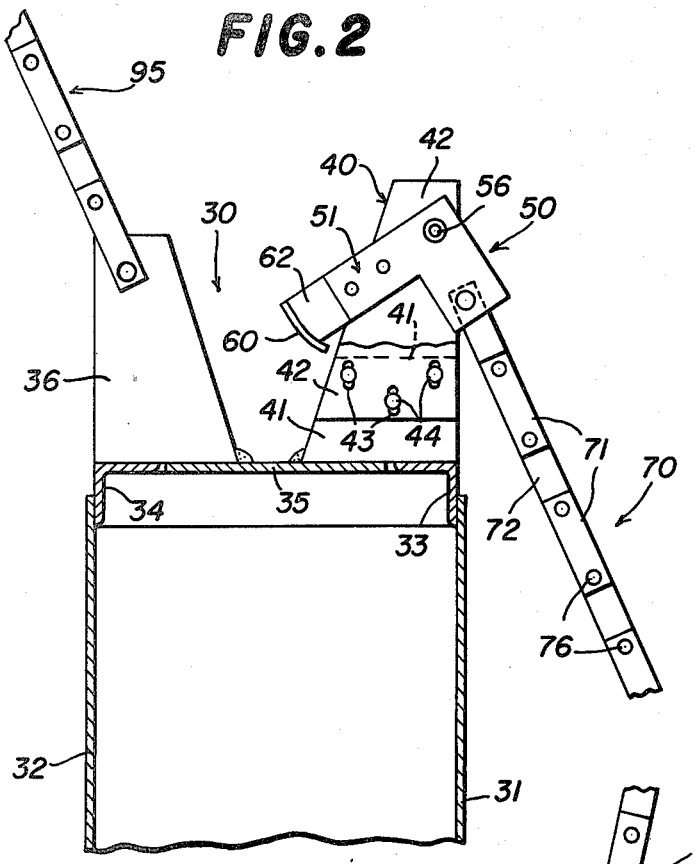
FIG. 2 is an enlarged fragmentary view in vertical section of the upper portion of one of the fender structures of FIG. 1, with portions broken away more clearly to show the structural details.

Referring also to FIG. 2 of the drawings, a substantially annular inner fender structure, generally designated by the numeral 30, is disposed in the gasholder 10 between the piston 20 and the side wall 12 and spaced therefrom. The fender structure 30 includes coaxial, vertically extending and radially spaced-apart inner and outer cylindrical side walls 31 and 32, which may be interconnected at the lower ends thereof by an annular bottom wall 37, and which are respectively provided at the upper ends thereof with annular inner and outer attachment rings 33 and 34, each being in the form of an angle iron substantially identical to the rings 16, 22 and 24. Fixedly secured to the top flanges of the inner and outer attachment rings 33 and 34 substantially coplanar therewith and closing the space therebetween is an annular top plate 35. Fixedly secured to the top plate 35 and the top flange of the outer attachment ring 34 and extending upwardly therefrom at circumferentially spaced-apart points therealong are a plurality of mounting plates or lugs 36 (one shown).

Interconnecting the piston 20 and the inner fender structure 30 is a flexible sealing member 38 which is in the form of an annular sheet of gas-impermeable fabric or the like. The inner edge of the flexible sealing member 38 is received through the aperture 19 in the piston 20 and overlies the upper flange of the bottom attachment ring 16, being fixedly secured thereto by a plurality of circumferentially spaced-apart fasteners 39. The outer edge of the sealing member 38 is fixedly secured to the inner fender structure 30 adjacent to the lower end thereof, and may be secured in the same manner as the inner edge is secured to the piston 20, i.e., by being received through an aperture in the inner side wall 31 and fixedly secured to an attachment ring.

Fixedly secured to the top plate 35 and the inner attachment ring 33 and extending vertically upwardly therefrom at circumferentially spaced-apart points therealong are a plurality of mounting clevises, each generally designed by the numeral 40 (one shown). Each of the mounting clevises 40 includes a pair of circumferentially spaced-apart upstanding baseplates 41 (one shown), and a pair of extension plates 42 respectively overlapping the outer surfaces of the baseplates 41 and fixedly secured thereto by a plurality of bolts 44 which extend through complementary openings in the baseplates 41 and through elongated openings 43 in the extension plates 42, the elongated openings 43 permitting adjustment of the height of the extension plates 42.

Figure 5:
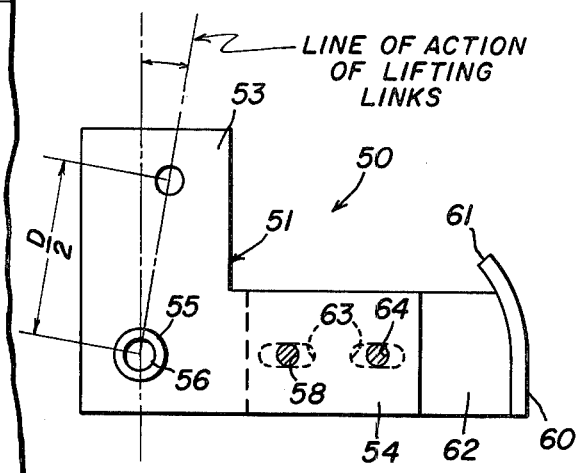
FIG. 5 is a further enlarged side elevational view of the latch mechanism of the present invention.
Figure 6:
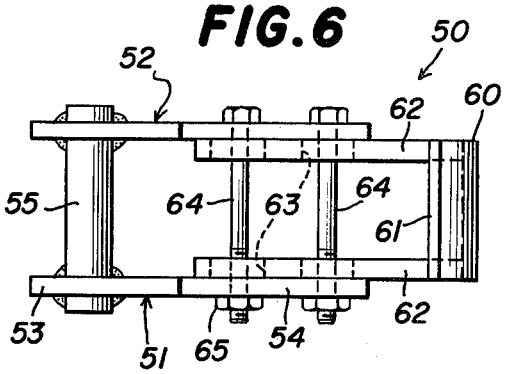
FIG. 6 is a top plan view of the latch mechanism illustrated in FIG. 5.

There are also provided a plurality of locking assemblies, each generally designated by the numeral 50, which are equal in number to the mounting clevises 40 and are respectively disposed between the extension plates 42 thereof. Referring also to FIGS. 5 and 6 of the drawings, each of the locking assemblies 50 includes a pair of generally L-shaped plates 51 and 52 which are disposed vertically in congruent relationship and are fixedly interconnected by a tubular member 55, through which is received a pivot shaft 56, the opposite ends of which are fixedly secured to the extension plates 42 of the mounting clevis 40 adjacent to the upper ends thereof, the plates 51 and 52 being pivotally movable about the axis of the shaft 56. Each of the plates 51 and 52 includes a relatively short arm 53 having an aperture 57 therethrough and a relatively long arm 54 having a pair of longitudinally aligned apertures 58 therethrough.

The locking assembly 50 includes a bearing footplate 60 having a curved upper end 61 and being fixedly secured between adjacent ends of two laterally spaced-apart legs 62 which are respectively disposed along the inner surfaces of the long arms 54 of the plates 51 and 52 and are fixedly secured thereto by bolts 64 extending through complementary openings in the arms 54 and legs 62 and cooperating with nuts 65, the legs 62 having elongated openings 63 therein to permit adjustment of the position of the bearing footplate 60, thereby effectively to adjust the overall length of the arms 54 as extended by the legs 62 and footplate 60.

Figure 7:
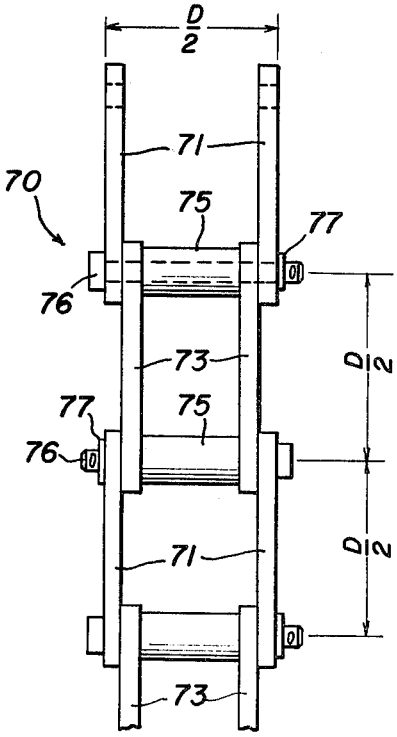
FIG. 7 is an enlarged fragmentary side elevational view of a portion of one of the linkage chains of the present invention.

Referring now also to FIG. 7 of the drawings, a connecting linkage, generally designated by the numeral 70, interconnects the attachment plate 27 of the piston 20 with the locking assembly 50. Preferably, the connecting linkage 70 is in the form of a length of roller chain, it being understood that a separate length 70 of such chain is provided for each of the attachment plates 27 for connecting it to the associated one of the locking assemblies 50. The connecting linkage 70 includes a plurality of pairs of laterally spaced-apart outer link plates 71, the pairs of plates 71 being longitudinally spaced apart and alternating with laterally spaced-apart pairs of inner link plates 73 having the end portions thereof disposed in overlapping relationship with the end portions of the adjacent outer link plates 71. Disposed between each pair of inner link plates 73 at the opposite ends thereof are two hollow tubular spacers or rollers 75, the overlapping ends of the link plates 71 and 73 and the adjacent rollers 75 being interconnected by a bolt 76 extending therethrough and secured in place as by a washer 77 and cotter pin (not shown), all in a well-known manner.

One end of the connecting linkage 70 is received between the short arms 53 of the associated locking assembly 50 and is pivotally secured thereto by a pivot pin extending through the chain links and through the complementary openings 57 in the arms 53. At the other end of the connecting linkage 70, the link plates 71 straddle in the attachment plate 27 and are pivotally secured thereto by a suitable pivot pin extending therethrough. The length of each chain 70 is such that the piston 20 and inner fender structure 30, including the attachment plates 27 and mounting clevises 40, are always disposed in vertically overlapping relationship with one another, the chains 70 preventing vertical displacement of the piston 20 and the inner fender structure 30 with respect to each other a sufficient distance so that either one can ride directly beneath the other.

Disposed between the inner fender structure 30 and the container side wall 12 and spaced therefrom is an annular outer fender structure, generally designated by the numeral 80, which is substantially identical in construction to the inner fender structure 30, with the exception that the outer fender structure 80 does not include the mounting lugs 36. A flexible sealing member 88, which is substantially identical to the flexible sealing member 38, interconnects the lower end of the inner fender structure 30 with the lower end of the outer fender structure 80 in the same manner as was described above in connection with the sealing member 38. In like manner, another sealing member 89 interconnects the lower end of the outer fender structure 80 with the side wall 12 of the gasholder 10 at a point intermediate the upper and lower ends thereof. The outer fender structure 80 is provided with a plurality of circumferentially spaced-apart locking assemblies 90, each of which is identical in construction to the locking assemblies 50 described above and is mounted in the same manner as are the locking assemblies 50. The short arms of the locking assemblies 90 are respectively connected to the corresponding ones of the mounting lugs 36 on the inner fender structure 30 by connecting linkages 95 which are respectively identical in construction to the connecting linkages 70, the lower ends of the connecting linkages 95 having the link plates thereof straddling the associated one of the mounting lugs 36 and pivotally connected thereto by a suitable pivot pin. The lengths of the connecting linkages 95 are such that the inner and outer fender structures 30 and 80 are always in vertically overlapping relationship with each other and neither can be moved directly beneath the other.

It can be seen that while each of the fender structures 30 and 80 and the sealing members 38, 88 and 89 is annular in shape, for simplicity only the vertical section thereof has been illustrated in the drawings.

In operation, when the gasholder 10 is empty, the piston 20 and fender structures 30 and 80 are disposed in the configuration illustrated in solid line in FIG. 1, with the piston 20 at rest on the gasholder floor 11. Preferably, the inner and outer fender structures 30 and 80 rest upon a support framework 98 at the bottom of the gasholder 10, so that by reason of the support framework 98, no load is borne by the flexible sealing members 38, 88 and 89 or the chains 70 and 95.

As the gas enters the bottom of the gasholder 10, it causes the piston 20 to rise, this vertical movement being accommodated by the flexible nature of the chains 70 and the sealing member 38. But because of the relative lateral inflexibility of the chains 70, the piston 20 is substantially inhibited from rotational movement with respect to the inner fender structure 30. The piston 20 continues to rise until it reaches the configuration illustrated in FIG. 4, at which point the upward movement of the piston 20 is limited by the length of the chains 70. With the chains 70 thus fully extended, the longitudinal axes thereof respectively intersect the axes of the pivot shafts 56 of the locking assemblies 50, the movement of the chains 70 to their fully extended positions respectively causing pivotal movement of the locking assemblies 50 to the position illustrated in FIG. 4, wherein the long arms 54 thereof extend radially inwardly toward the piston 20 spaced a slight distance therefrom so as substantially to inhibit lateral or radial movement of the piston 20 with respect to the inner fender structure 30. It will be noted that the stiffening ring 22 is positioned adjacent to the point where the footplates 60 of the locking assemblies 50 engage the piston side wall 21 to prevent denting of caving-in thereof.

When the piston 20 has thus moved upwardly to the position illustrated in FIG. 4, further lifting thereof serves also to lift the inner fender structure 30 until the chains 95 are fully extended upwardly, at which point the locking assemblies 90 have been pivoted to the position illustrated in broken line in FIG. 1 for preventing lateral or radial movement of the inner fender structure 30 with respect to the outer fender structure 80. Further upward movement of the piston 20 and inner fender structure 30 serves to lift the outer fender structure 80 to the position illustrated in broken line in FIG. 1, which represents the maximum volume of the expansible storage chamber defined beneath the piston 20 and inner and outer fender structures 30 and 80.

In a constructional example of the gasholder 10, the vertical distance between the top plates of the inner and outer fender structures 30 and 80 and the axes of rotation of the locking assemblies 50 and 90 is approximately equal to 1.5 times the radial distance "D" between the piston 20 and the inner fender structure 30 and between the inner fender structure 30 and the outer fender structure 80. Also, the vertical height of each of the attachment plates 27 and mounting lugs 36 is approximately equal to 1.5D. It will be understood that the piston 20 is capable of a maximum vertical movement equal to twice the maximum vertical distance between the axis of the pivot shaft 56 and the pivot axis of the coupling between the attachment plates 27 and the lower end of the chain 70. In like manner, the inner fender structure 30 is capable of a maximum vertical movement equal to twice the maximum vertical distance between the pivot axis of the locking assembly 90 and the pivot axis of the coupling between the mounting lug 36 and the lower end of the chain 95. Preferably, the chains 70 and 95 each has a length approximately in the range of about 30D to about 40D, the chain in the fully extended condition thereof forming an angle with the vertical, the tangent of which is approximately equal to D divided by the vertical height of the fender structure. The distance between the axes of the pivot shaft 56 and the aperture 57 is approximately equal to D/2, these axes defining a plane inclined at an acute angle to the longitudinal axis of the short arms 53 of the plates 51 and 52. The distance between the outer surfaces of the plates 51 and 52 of the locking assembly 50 and the lateral distance between the outer surfaces of the outer link plates 71 and the longitudinal distance between the axes of adjacent rollers 75 of the chain 70 are each approximately equal to D/2. Preferably, the circumferential spacing between adjacent ones of the locking assemblies 50 is approximately equal to ¼ the diameter of the gasholder side wall 12.

It will be appreciated that while two fender structures 30 and 80 have been illustrated, any desired number could be utilized, with adjacent fender structures being interconnected by the locking assemblies and connecting linkages of the present invention. It will also be appreciated that by reason of the method of attachment of the flexible sealing members 38, 88 and 89, each of these attachments as well as each of the locking assemblies 50 and 90 and connecting linkages 70 and 95 is fully accessible from thereabove.

From the foregoing, it can be seen that there has been provided an improved lifting mechanism for a dry seal gasholder, wherein the piston and fender structures are maintained in proper alignment during the raising and lowering thereof, without any undue strain on the flexible sealing members.

While there has been described what is at present considered to be the preferred embodiment of the invention, it will be understood that various modifications may be made therein, and it is intended to cover in the appended claims all such modifications as fall within the true spirit and scope of the invention.

What is claimed is:

1. An expansible fluid storage apparatus, comprising a container having a vertically extending side wall, a vertically movable piston disposed within said side wall and spaced a predetermined distance therefrom, a vertically movable generally annular fender structure disposed between said side wall and said piston and spaced therefrom, first flexible sealing means interconnecting said piston and said fender structure and closing the space therebetween, second flexible sealing means interconnecting said fender structure and said side wall and closing the space therebetween, and linkage mechanism permanently interconnecting said piston and said fender structure for accommodating vertical movement thereof with respect to each other and substantially preventing circumferential movement thereof with respect to each other, said linkage mechanism having a length such that said piston and said fender structure are at all times in vertically overlapping relationship with one another so that neither said piston nor said fender structure can move directly beneath the other, whereby said piston and said fender structure and said sealing means cooperate with said sidewall to define an expansible storage chamber with said linkage mechanism serving to maintain said piston and said fender structure in proper alignment.

2. The apparatus set forth in claim 1, wherein said linkage mechanism comprises a plurality of circumferentially spaced-apart chains, each chain including a plurality of interconnected links pivotally movable with respect to each other about substantially parallel axes.

3. The apparatus set forth in claim 1, wherein one end of said linkage mechanism is connected to the top of said piston and the other end of said linkage mechanism is connected to the top of said fender structure.

4. The apparatus set forth in claim 1, and further including adjustable coupling means coupling said linkage mechanism to said fender structure and adjustable effectively to vary the length of said linkage mechanism.

5. An expansible fluid storage apparatus, comprising a container having a vertically extending side wall, a vertically movable piston disposed within said side wall and spaced a predetermined distance therefrom, a vertically movable generally annular fender structure disposed between said side wall and said piston and spaced therefrom, first flexible sealing means interconnecting said piston and said fender structure and closing the space therebetween, second flexible sealing means interconnecting said fender structure and said side wall and closing the space therebetween, and linkage mechanism permanently interconnecting said piston and said fender structure, said linkage mechanism including latch mechanism responsive to movement of said piston a predetermined distance above said fender structure for moving to a latching configuration engageable with said piston effectively to prevent lateral movement of said piston and said fender structure with respect to each other, said linkage mechanism having a length such that said piston and said fender structure are at all times in vertically overlapping relationship with one another so that neither said piston nor said fender structure can move directly beneath the other, whereby said piston and said fender structure and said sealing means cooperate with said side wall to define an expansible storage chamber with said latch mechanism serving to maintain said piston and said fender structure in proper alignment.

6. The apparatus set forth in claim 5, wherein said latch mechanism includes a generally L-shaped member pivotally mounted on said fender structure and having a first arm coupled to said linkage mechanism for movement thereby and a second arm adapted for engagement with said piston.

7. The apparatus set forth in claim 5, wherein said latch mechanism includes an abutment member adapted for engagement with said piston.

8. The apparatus set forth in claim 5, wherein said latch mechanism includes a generally L-shaped member pivotally mounted on said fender structure and including a first arm coupled to said linkage mechanism and a second arm, said second arm including an adjustable abutment member adjustable effectively to vary the length of said second arm and adapted for engagement with said piston.

9. The apparatus set forth in claim 6, and further including reinforcing means carried by said piston for reinforcing the region thereof engageable by said latch mechanism.

10. An expansible fluid storage apparatus, comprising a container having a vertically extending side wall, a vertically movable piston disposed within said side wall and spaced a predetermined distance therefrom, a vertically movable generally annular fender structure disposed between said side wall and said piston and spaced therefrom, first flexible sealing means interconnecting said piston and said fender structure and closing the space therebetween, second flexible sealing means interconnecting said fender structure and said side wall and closing the space therebetween, and linkage mechanism permanently interconnecting said piston and said fender structure for accommodating vertical movement thereof with respect to each other and substantially preventing circumferential movement thereof with respect to each other, said linkage mechanism including latch mechanism responsive to movement of said piston a predetermined distance above said fender structure for moving to a latching configuration engageable with said portion effectively to prevent lateral movement of said piston and said fender structure with respect to each other, said linkage mechanism having a length such that said piston and said fender structure are at all times in vertically overlapping relationship with one another so that neither said piston nor said fender structure can move directly beneath the other, whereby said piston and said fender strucutre and said sealing means cooperate with said side wall to define an expansible storage chamber with said linkage mechanism and said latch mechanism serving to maintain said piston and said fender structure in proper alignment.

11. The apparatus set forth in claim 10, wherein said fender structure includes first and second annular fender members disposed coaxially between said piston and said side wall and spaced therefrom and from each other, said first flexible sealing means interconnecting said piston and said first fender member for closing the space therebetween, said second flexible sealing means interconnecting said second fender member and said wall for closing the space therebetween, third flexible sealing means interconnecting said first and second fender members and closing the space therebetween, second linkage mechanism interconnecting said first and second fender members for accommodating vertical movement thereof with respect to each other and substantially preventing circumferential movement thereof with respect to each other, and second latch mechanism coupled to said second linkage mechanism and responsive to movement of said first fender member a predetermined distance above said second fender member for moving to a latching configuration engageable with said first fender member effectively to prevent lateral movement of said first and second fender members with respect to each other.

12. The apparatus set forth in claim 10, wherein one end of said linkage mechanism is pivotally coupled to the top of said piston and the other end of said linkage mechanism is pivotally coupled to said latch mechanism, said latch mechanism being pivotally coupled to the top of said fender structure.

13. The apparatus set forth in claim 10, and further including a coupling clevis carried by said fender structure at the upper end thereof and including a pair of clevis arms, said latch mechanism being disposed in use between said clevis arms and pivotally mounted thereon.

14. The apparatus set forth in claim 13, wherein each of said clevis arms is adjustable in length effectively to vary the length of said linkage mechanism.

15. An expansible fluid storage apparatus, comprising a container having a vertically extending side wall, a vertically movable piston disposed within said side wall and spaced a predetermined distance therefrom, a vertically movable generally annular fender structure disposed between said side wall and said piston and spaced therefrom, first flexible sealing means interconnecting said piston and said fender structure and closing the space therebetween, second flexible sealing means interconnecting said fender structure and said side wall and closing the space therebetween, linkage mechanism permanently interconnecting said piston and said fender structure and including a chain having a plurality of links pivotally movable with respect to one another about parallel axes, said chain accommodating vertical movement of said piston and said fender structure with respect to each other and substantially preventing relative movement thereof in directions parallel to said pivot axes, said linkage mechanism including a generally L-shaped latch member mounted on said fender structure for pivotal movement about a second axis disposed substantially parallel to said first axis, said latch member having a first arm pivotally connected to one end of said chain for movement thereby and a second arm provided with an abutment surface, said latch member being responsive to movement of said piston to a predetermined configuration above said fender structure wherein said chain is fully extended for movement by said chain to a latching configuration wherein the longitudinal axis of said chain intersects said second axis and wherein said abutment surface is disposed for engagement with said piston effectively to prevent lateral movement of said piston and said fender structure with respect to each other, said linkage mechanism having a length such that said piston and said fender structure are at all times in vertically overlapping relationship with one another so that neither said piston nor said fender structure can move directly beneath the other, whereby said piston and said fender structure and said sealing means cooperate with said side wall to define an expansible storage chamber with said chain and said latch member serving to maintain said piston and said fender structure in proper alignment.

16. The apparatus set forth in claim 15, wherein said fender structure includes first and second annular fender members disposed coaxially between said piston and said side wall and spaced therefrom and from each other, said first flexible sealing means interconnecting said piston and said first fender member for closing the space therebetween, said second flexible sealing means interconnecting said second fender member and said side wall for closing the space between, third flexible sealing means interconnecting said first and second fender members and closing the space therebetween, a second chain interconnecting said first and second fender members for accommodating vertical movement thereof with respect to each other and substantially preventing circumferential movement thereof with respect to each other, and a second latch member coupled to said second chain and responsive to movement of said first fender member a predetermined distance above said second fender member for moving to a latching configuration engageable with said first fender member effectively to prevent lateral movement of said first and second fender members with respect to each other.

17. The apparatus set forth in claim 15, wherein said latch member includes a pair of spaced-apart plates disposed substantially normal to said axis of rotation, and means rigidly interconnecting said plates.

18. The apparatus set forth in claim 15, wherein said latch mechanism further includes an abutment member having a pair of elongated arms disposed between said plates at the portions thereof defining said second arm and adjustably coupled thereto for engagement with said portion, said abutment member being adjustable effectively to vary the length of said second arm.

19. The apparatus set forth in claim 15, and further including a coupling clevis carried by said fender structure at the upper end thereof and including a pair of clevis arms, said latch mechanism being disposed in use between said clevis arms and pivotally mounted thereon, said latch mechanism including a pair of spaced-apart plates disposed between said clevis arms and substantially normal to said axis of rotation, and means rigidly interconnecting said plates for rotation thereof as a unit.

* * * * *

UNITED STATES PATENT AND TRADEMARK OFFICE

CERTIFICATE OF CORRECTION

PATENT NO. : 4,132,532

DATED : January 2, 1979

INVENTOR(S) : Milton W. Heisterberg

It is certified that error appears in the above-identified patent and that said Letters Patent are hereby corrected as shown below:

Column 6, line 40, "of" should be --or--.
Column 8, line 65, "6" should be --5--.
Column 9, line 20, "portion" should be --piston--;
line 40, after "said" second occurrence insert --side--.
Column 10, line 56, "between" should be --therebetween--.
Column 12, line 1, "portion" should be --piston--.

Signed and Sealed this

First Day of May 1979

[SEAL]

*Attest:*

RUTH C. MASON
*Attesting Officer*

DONALD W. BANNER
*Commissioner of Patents and Trademarks*